US006632540B2

(12) United States Patent
DiChiara, Jr. et al.

(10) Patent No.: US 6,632,540 B2
(45) Date of Patent: Oct. 14, 2003

(54) CEMENTITIOUS CERAMIC SURFACE HAVING CONTROLLABLE REFLECTANCE AND TEXTURE

(75) Inventors: Robert A. DiChiara, Jr., San Diego, CA (US); Robert W. Kreutzer, Poway, CA (US)

(73) Assignee: McDonnell Douglas Corporation, Huntington Beach, CA (US)

( * ) Notice: Subject to any disclaimer, the term of this patent is extended or adjusted under 35 U.S.C. 154(b) by 18 days.

(21) Appl. No.: 10/223,951

(22) Filed: Aug. 20, 2002

(65) Prior Publication Data

US 2002/0192512 A1 Dec. 19, 2002

Related U.S. Application Data

(62) Division of application No. 08/235,372, filed on Apr. 29, 1994, now Pat. No. 6,479,104.

(51) Int. Cl.[7] ..... B32B 3/00; B32B 18/00

(52) U.S. Cl. ..... 428/472.2; 428/472.3

(58) Field of Search ..... 428/446, 447, 428/450, 457, 469, 472.2, 472.3

(56) References Cited

U.S. PATENT DOCUMENTS 3,888,687 A 6/1975 Manigault
4,440,865 A 4/1984 Salazar
4,587,172 A 5/1986 Roy et al.
4,722,916 A 2/1988 Watanabe et al.
4,792,359 A * 12/1988 Barrall et al. ..... 106/85
5,358,676 A 10/1994 Jennings et al.
5,371,050 A 12/1994 Belitskus et al.
5,980,980 A * 11/1999 DiChiara, Jr. et al. ... 106/286.6

FOREIGN PATENT DOCUMENTS

JP 52-152941 12/1977

OTHER PUBLICATIONS

Lachman, et al., *Thermal Expansion Of Extruded Cordierite Ceramics, Ceramic Bulletin*, 1981, pp. 202–205, 60(2).

* cited by examiner

*Primary Examiner*—Erma Cameron
(74) *Attorney, Agent, or Firm*—Alston & Bird LLP

(57) ABSTRACT

An article is fabricated with a ceramic surface having a controllable surface finish. In one form, the ceramic is applied as a coating to a substrate article. Preferably, an aqueous coating mixture of phosphoric acid, alumina powder, and cordierite powder is prepared. The mixture is contacted to the surface of the article, and a mechanical overpressure is applied to the external surface of the mixture using a pressing tool. The surface character of the pressing tool, such as a smooth surface or an intentionally patterned surface, is reproduced on the surface of the final ceramic coating. The coating is heated to a moderate temperature to set the ceramic of the coating, and thereafter the coating is heated to a higher, but still intermediate temperature, to cure the coating.

14 Claims, 2 Drawing Sheets

CEMENTITIOUS CERAMIC SURFACE HAVING CONTROLLABLE REFLECTANCE AND TEXTURE

CROSS REFERENCE TO RELATED APPLICATION(S)

The present application is a divisional of U.S. patent application Ser. No. 08/235,372 entitled Cementitious Ceramic Surface Having Controllable Reflectance and Texture by Robert A. DiChiara, Jr., et al., filed April 29, 1994, now U.S. Pat. No. 6,479,104 the contents of which is incorporated in their entirety herein.

BACKGROUND OF THE INVENTION

This invention relates to articles having a ceramic surface and, more particularly, to a cementitious ceramic coating having a controllable surface reflectance and texture.

Ceramic coatings are sometimes used to protect and/or insulate substrate articles that would otherwise be subject to mechanical or thermal damage. Ceramics are typically hard and resistant to abrasion damage and the like. They also can have a low coefficient of thermal conductivity and act as insulators for the underlying structure. At their present state of development, ceramics are not widely used as the underlying structural components because of their low ductility and fracture toughness.

When applied as coatings, cementitious ceramics typically have uncontrolled, but usually poor, reflection surface characteristics. For example, such ceramic coatings may be applied by gunning and curing techniques, which result in a relatively rough coating surface that has poor reflection properties. Ceramic coatings may be applied by plasma spraying and related techniques, again producing a surface that is largely uncontrolled. The term "uncontrolled" is used here to mean that little if any independent control can be exerted over the character of the surface, to provide a selectable type of surface reflectance and texture.

Ceramic coatings can also be made by physical vapor deposition (PVD) techniques such as sputtering or thermal evaporation. These coatings are typically very thin (i.e., less than one micrometer in thickness). The coatings can be made to be glossy and highly reflective under some deposition conditions, but they follow the underlying surface topography and are not thick enough to form a three-dimensional textured surface.

Reflective ceramic surfaces can be formed with glazing techniques such as used on dinnerware. Finely divided glass, termed glass frit, is sprayed onto the surface of a ceramic substrate. The ceramic and glass frit are heated to a high temperature to cause the glass frit to melt and flow, creating a smooth, glazed ceramic surface coating which follows the contour of the ceramic substrate. The glassy surface coating is not, however, "set" in the manner of a cementitious coating, and will reflow if the glassy coating is heated above its glass transition temperature.

The surface finish of any material, including a ceramic coating, may be of importance in many applications. The surface smoothness influences properties such as aerodynamic resistance, boundary layer thickness, aerothermal heating, and the like. The ability of the surface to reflect light determines, in part, its resistance to damage from impinging high-intensity light beams. Various techniques are available for controlling the surface character of metals and polymers, but, as discussed, it has been difficult to selectively control the surface finish of cementitious ceramic coatings. Thus, for example, it has not been possible to apply a smooth, highly reflective cementitious ceramic coating to a metallic, ceramic, or polymeric substrate, with a controllable surface texture. Such coatings, if available, would be valuable tools in controlling surface mechanical and thermal properties.

There is therefore a need for a technique for producing a controllably reflective surface on cementitious ceramics, and particularly on cementitious ceramic coatings. Such a technique desirably permits the coatings to be applied to a variety of substrates and with a variety of surface textures, while simultaneously yielding a highly reflective coating. The present invention fulfills this need, and further provides related advantages.

SUMMARY OF THE INVENTION

The present invention provides a method for preparing a controllably reflective cementitious ceramic surface, typically in the form of a coating, and an article having such a ceramic surface. The approach allows all processing to be completed at intermediate temperatures, but the ceramic may be used to much higher temperatures in service without loss of the desirable surface properties. The relatively low processing temperature also permits relatively inexpensive tooling and heating equipment to be used. Thus, a reflective cementitious coating can be applied to many substrates without removing the substrates from their underlying structure, so that field installations and repairs are practical. In a preferred form, the surface of the ceramic is highly reflective of visible light. A surface texture can be applied to the surface of the ceramic, without sacrificing the reflective finish.

In accordance with the invention, a method for preparing an article having a ceramic surface comprises the steps of providing an article having a surface to be coated and preparing an aqueous mixture of a source of a reactive phosphate ion and a nonmetallic ceramic form of a cation reactive with phosphate ion to form a ceramic phosphate. The mixture is contacted to the surface of the article, and a mechanical overpressure is applied to the mixture at the surface of the article. The mixture is set, typically just after the application of the overpressure, and thereafter cured without any overpressure.

In one preferred application, the source of reactive phosphate ion is phosphoric acid, and the nonmetallic ceramic form of a cation is a mixture of alumina powder and cordierite powder. The mechanical overpressure is applied either with a smooth tool or an intentionally textured tool to produce a controllably textured, preselected final surface profile in the coating. The coating may be applied to a wide variety of substrate articles, such as, for example, metals, metal-matrix composites, ceramics, ceramic-matrix composites, organic materials, and organic-matrix composites.

In another aspect of the invention, a method for preparing an article having a ceramic surface comprises the steps of preparing an aqueous mixture of a source of a reactive phosphate ion and a nonmetallic ceramic form of a cation reactive with phosphate ion to form a ceramic phosphate and placing the mixture at the surface of an article. A mechanical overpressure is applied to the mixture at the surface of the article, and the mixture is set and cured.

The approach of the invention provides an advance in the art of ceramic materials. Bulk and coated cementitious ceramics with controllably reflective surfaces can be prepared with the use of no more than intermediate processing temperatures. The surface can also be textured, if desired, in the same processing. The ceramics can be used to much higher temperatures without loss of the surface properties. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
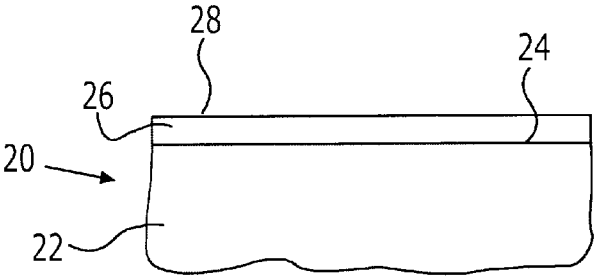
FIG. 1 is a schematic side elevational view of a ceramic-coated substrate article.
Figure 2:
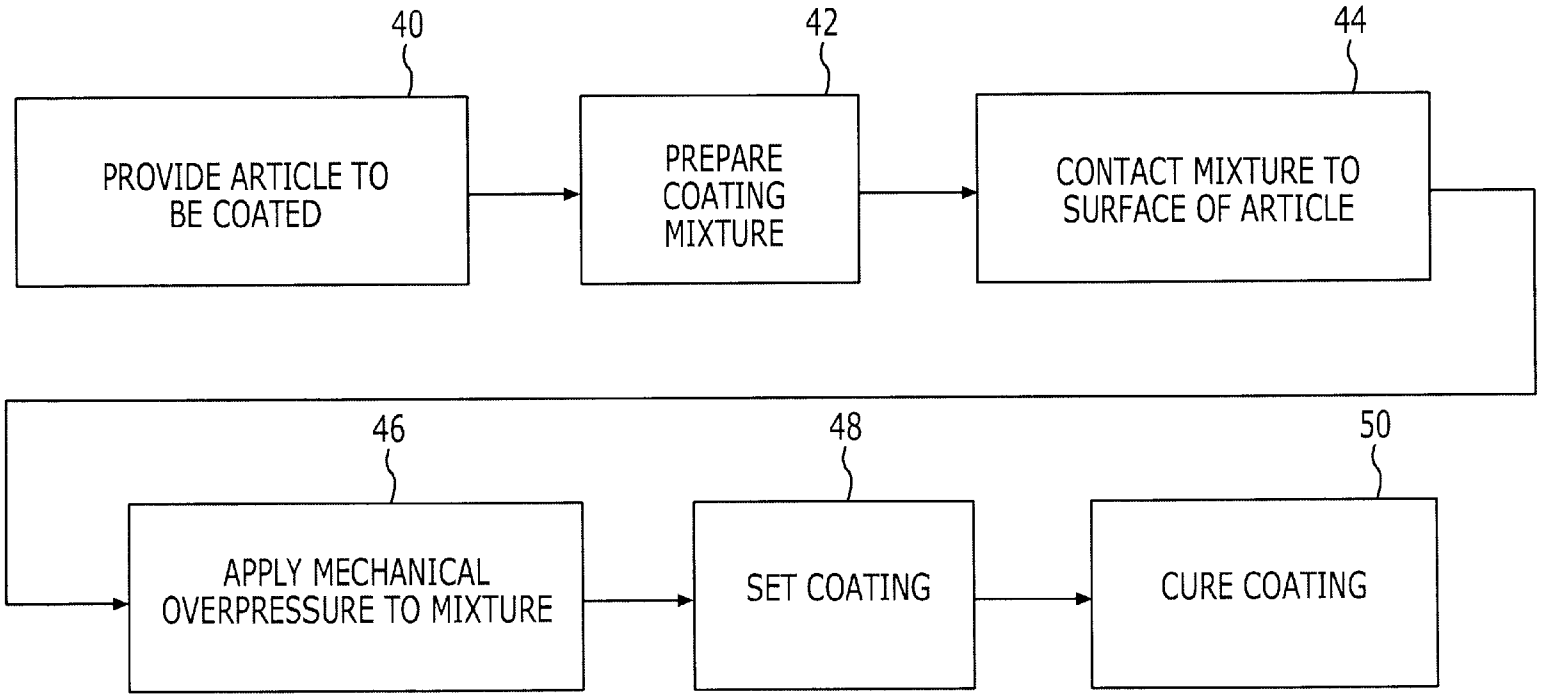
FIG. 2 is a flow chart for the preparation of the ceramic-coated substrate article of FIG. 1.

In one preferred embodiment depicted in FIGS. 1–2, the invention provides a ceramic-coated article 20. The ceramic-coated article 20 comprises a substrate article 22 of any desired shape. The substrate article 22 has an article surface 24 that is to be coated, which article surface 24 may constitute all or a portion of the total surface area of the article 22. A cementitious ceramic coating 26 is bonded to the article surface 24. The ceramic coating 26 has a coating surface 28 that is controllable in its character, but in a preferred form is highly reflective to visible light.

In preparing such a ceramic-coated article 20, the substrate article 22 is first provided, numeral 40 of FIG. 2. The substrate article 22 may be made of any suitable material, including, for example, a metal, a metal-matrix composite, a ceramic, a ceramic-matrix composite, a polymer, or a polymer-matrix composite. The principal limitation on the nature of the substrate article is that it must withstand the intermediate curing temperature used in subsequent processing.

A coating mixture is prepared, numeral, 42. The coating of the invention is based upon the production of a phosphate-bonded ceramic surface coating. To produce the surface coating, a reactive source of phosphate ions and a nonmetallic ceramic form of a cation reactive with phosphate ion to form a ceramic phosphate are provided. The reactive source of phosphate ions is preferably concentrated phosphoric acid. Other sources such a monoaluminum phosphate can also be used. "Monoaluminum phosphate" is available commercially as a mixture containing monoaluminum phosphate, $Al(H_2PO_4)_3$, and related species such as $AlH_3(PO_4)_2.H_2O$ and $Al_2(HPO_4)_3$, and such mixtures are operable and acceptable in the present approach.

The ceramic form of a cation is reactable with the source of the phosphate ions to produce a cementitious ceramic phosphate compound. The preferred reactive ceramic form is a reactive oxide. The reactive phosphate ion reacts with several oxides of a weakly basic or amphoteric nature to produce phosphate forms. Optimum bonding is produced using weakly basic or amphoteric cations having moderately small ionic radius. Oxides of cations from the following group are particularly preferred: beryllium, aluminum, iron, magnesium, calcium, thorium, barium, zirconium, zinc, and silicon. Such oxides also include complex oxides, such as aluminum magnesium oxides. Mixtures of the various reactive species are also operable, particularly to achieve desirable combinations of properties in the final phosphate structure. Other reactive ceramic forms that react to produce phosphate bonded phases, such as magnesium phosphate, $Mg_3(PO_4)_2$ are also operable. The reactive ceramic forms can be selected to achieve particular desirable final properties in the coating, such as gloss, wear resistance, coefficient of thermal expansion, capacitance, ferroelectric properties, ferrimagnetic properties, piezoelectric properties, etc.

The reactive ceramic form can be provided as a pure chemical species, or as a mineral source of that species with impurities and other species present, as long as the other species do not interfere with the reactivity to form the phosphate-bonded coating. For example, aluminum oxide can be provided as pure $Al_2O_3$, or as a mineral such as kaolin, potash feldspar, or bauxite. In another example, magnesium oxide can be provided as pure MgO or magnesite or dolomite. Other sources of these and other reactive ceramic compounds can also be used.

In a most preferred approach, concentrated phosphoric acid and a mixture of alumina and cordierite are used to practice the invention. An aqueous mixture of phosphoric acid, alumina ($Al_2O_3$) powder, and cordierite ($MgAlSiO_3$) powder is prepared. The mixture contains from about 5 to about 60 parts by weight of phosphate, from about 5 to about 95 parts by weight of alumina, and from about 95 to about 5 parts by weight of cordierite. This wide range of alumina-to-cordierite content permits a wide range of surface properties to be achieved.

In the most preferred approach, alumina particles of at least two different size ranges are utilized. The alumina is a mixture of from about 0 to about 20 parts by weight of fine alumina particles having a size of about 0.5 micrometers and from about 0 to about 40 parts by weight of coarse alumina particles having a size of about 3 micrometers. The cordierite powder preferably has a size of from about 3 to about 18 micrometers.

In this preferred approach, the surface finish is determined in part by the ratio of fine and coarse alumina powder. The more fine alumina powder in the mixture, the smoother the surface finish and the higher its reflectance. The more coarse alumina powder, the rougher the surface finish and the lower its reflectance. The use of a mixture of particulate sizes also improves the packing density of the solid phase, which results in reduced shrinkage upon curing. The more total alumina powder that is used, the more aluminum orthophosphate, $AlPO_4$, is produced and the higher the coefficient of thermal expansion of the resulting surface region. The cordierite is added to reduce the coefficient of thermal expansion of the surface region to more closely match that of the underlying article, if and as necessary. Because the coating bonds to the substrate at relatively low temperatures of less than about 300° F., it is highly desirable to select the proportions so that the coating has a slightly higher coefficient of thermal expansion than the article substrate upon which it is applied. The resulting coating is in compression during service. However, since alumina is harder than cordierite, the addition of cordierite reduces the hardness of the final product. The proportions of the ceramic phase components are selected to achieve a compromise of properties acceptable for a particular application. Water is added to the mixture in an amount sufficient to provide the desired consistency for application of the mixture to the substrate article 22.

In a most preferred approach, about 21.3 parts by weight of 85 percent concentration phosphoric acid, about 12.1 parts by weight of deionized water, about 44 parts by weight of Alcoa A-16SG alumina powder having a mean particle size distribution of 0.5 micrometers, about 19.9 parts by weight of Alcoa A-17SG alumina powder having a mean particle size distribution of 3 micrometers, and about 40.0 parts by weight of cordierite powder having a mean particle size distribution of 18 micrometers were thoroughly mixed together. This ceramic mixture had a consistency comparable with that of paint.

Optionally, as part of the preparation of the coating mixture, the ceramic-containing mixture may be deaired. To remove any air introduced during mixing, the slurried ceramic mixture is placed into a vacuum of about 20 inches of mercury for a period of 15 minutes.

The ceramic mixture is contacted to the substrate surface 22 by any operable technique, numeral 44. Particularly where the surface 22 is itself rather smooth, care must be taken to achieve good adherence and bonding of the ceramic mixture (and eventually the coating 26) to the substrate surface 22. In one preferred approach, a portion of the mixture is spread onto a tool made of material that will not react with the phosphoric acid, such as a polyimide or polytetrafluoroethylene (teflon), and which has been previously coated with a silicone release agent. This portion of the ceramic mixture is heated to a temperature of about 195° F. to evaporate water from the ceramic mixture until the mixture has a consistency comparable with that of putty. A second portion of the ceramic mixture is spread as a thin layer on the article surface 24 to aid in adhesion. The article surface 24 is inverted over the tool so that the first portion of the ceramic mixture contacts the second portion.

A mechanical overpressure is applied to the ceramic mixture while it is in contact with the article surface 24, numeral 46. The overpressure is preferably applied by squeezing together the article and the ceramic mixture contacting the surface, with a pressing tool contacting the ceramic mixture. The pressing tool may conveniently be the same tool used in applying the first portion of the ceramic mixture. The applied pressure is selected so as to impose a surface texture and character on the top surface of the mixture, but cannot be so great that the mixture is extruded away around the sides of the pressing tool.

The coating is set to harden it for further handling, numeral 48. The setting is accomplished by heating the coating to a temperature of about 350° F. to about 390° F.

The application of the mechanical overpressure, numeral 46, and the setting of the coating, numeral 48, are preferably conducted in a coordinated, concurrent fashion. The mechanical pressure is initially applied prior to heating, but is maintained during heating and while the temperature is maintained at about 195° F. to allow the coating to set. For the preferred application procedure discussed above, a pressure of about 100 pounds per square inch (psi) is initially applied for 10 minutes, with the mixture and the substrate article at 195° F. The pressure is increased to about 200 psi and held for 1 hour. The temperature is then increased at a rate of about 1° F. per minute to 250° F., and thereafter increased at a rate of 5–10° F. per minute to the setting temperature of 390° F. The overpressure and temperature are maintained for 2 hours to complete the setting of the cementitious ceramic coating.

The setting operation sets the ceramic to a partially hardened state that can be handled. The overpressure is removed and the temperature reduced to ambient. The coated article is removed from the heated press in which the pressing and setting are performed.

The article with the set, partially hardened coating is heated to cure the coating, numeral 50. The curing operation hardens the coating to its full hardness. In the preferred approach, full curing is accomplished by heating to a temperature of about 650° F. to about 750° F. for about 1 hour.

The setting and curing steps can be performed using a press and a furnace, if the substrate article 22 can be readily inserted into an available press and furnace. An autoclave can also be used in the case of more complex shapes. Alternatively, it may be the case that the substrate article is part of a larger structure, and it is inconvenient to remove the substrate article from its place in the larger structure. In that event, the mechanical pressing 46 can be accomplished with mechanical clamps. The setting step 48 and the curing step 50 can be accomplished using quartz heat lamps or other surface heater. The application of the coating can thereby be accomplished without removing the substrate article from its larger structure. Field application and repair are thereby made practical.

The coating surface 28 prepared by this preferred approach is dense, glossy, and has a reflectance of light in the visible range of about 90 percent or more. The pattern of the pressing tool is embossed onto the surface of the coating. The surface roughness is about 0.1 micrometers. No polishing is required to achieve this surface state.

By varying the process parameters, and specifically the relative amounts of fine and coarse alumina powder, the reflectance of the surface may be varied from glossy to dull, as described previously.

The ceramic surface may be characterized by its texture at a macroscopic level. As used herein, the "texture" of the surface is its patterning visible to the naked eye. Its "reflectance" is a physical property measurement. Both the texture and the reflectance, of the coating are controllable by using the approach of the invention. The pattern present on the face of the pressing tool is replicated in the surface of the coating surface 28. If, for example, the face of the pressing tool is flat and very smooth, the coating surface 28 is also flat and highly reflective. If the face of the pressing tool is, for example, corrugated but very smooth in the corrugations, the coating surface 28 is also corrugated in a mirror image of the face of the pressing tool, with all portions of each corrugation on the surface 28 being highly reflective. That is, both the macroscopic and microscopic character of the pressing tool is replicated in the final ceramic surface. The reflectance of the surface is also determined in part by the sizes and types of powders used in the ceramic mixture, as discussed previously.

The character of the coating surface 28 is present at ambient temperature and is preserved to elevated temperatures as high as about 2000° F. This elevated temperature behavior, above the processing temperatures for setting and curing, is significantly different from that of glassy, glazed coatings. In the case of glazed coatings, reflective coatings can be obtained with a high firing temperature, but surface patterns cannot be prepared. But, with such glazed surface coatings, upon reheating above the glass softening temperature the glass reflows and the surface character is lost. The present approach therefore provides a unique, high-temperature, reflective cementitious coating on the article which does not reflow upon heating.

Figure 3:
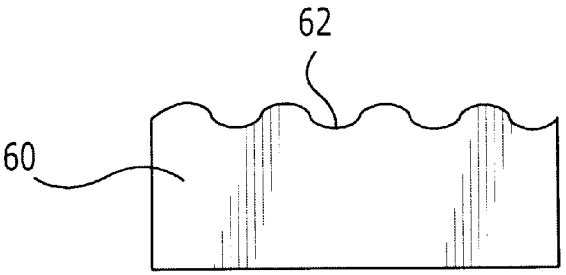
FIG. 3 is a schematic side elevational view of a bulk ceramic article.

The present invention may also be used to make a bulk ceramic article 60 having a controllably reflective surface 62, as shown in FIG. 3. (The surface 62 is shown as corrugated while the surface 28 of FIG. 1 is shown as flat to illustrate the controllability of the surface texture as well, but either type of surface may be prepared in each case.)

Figure 4:
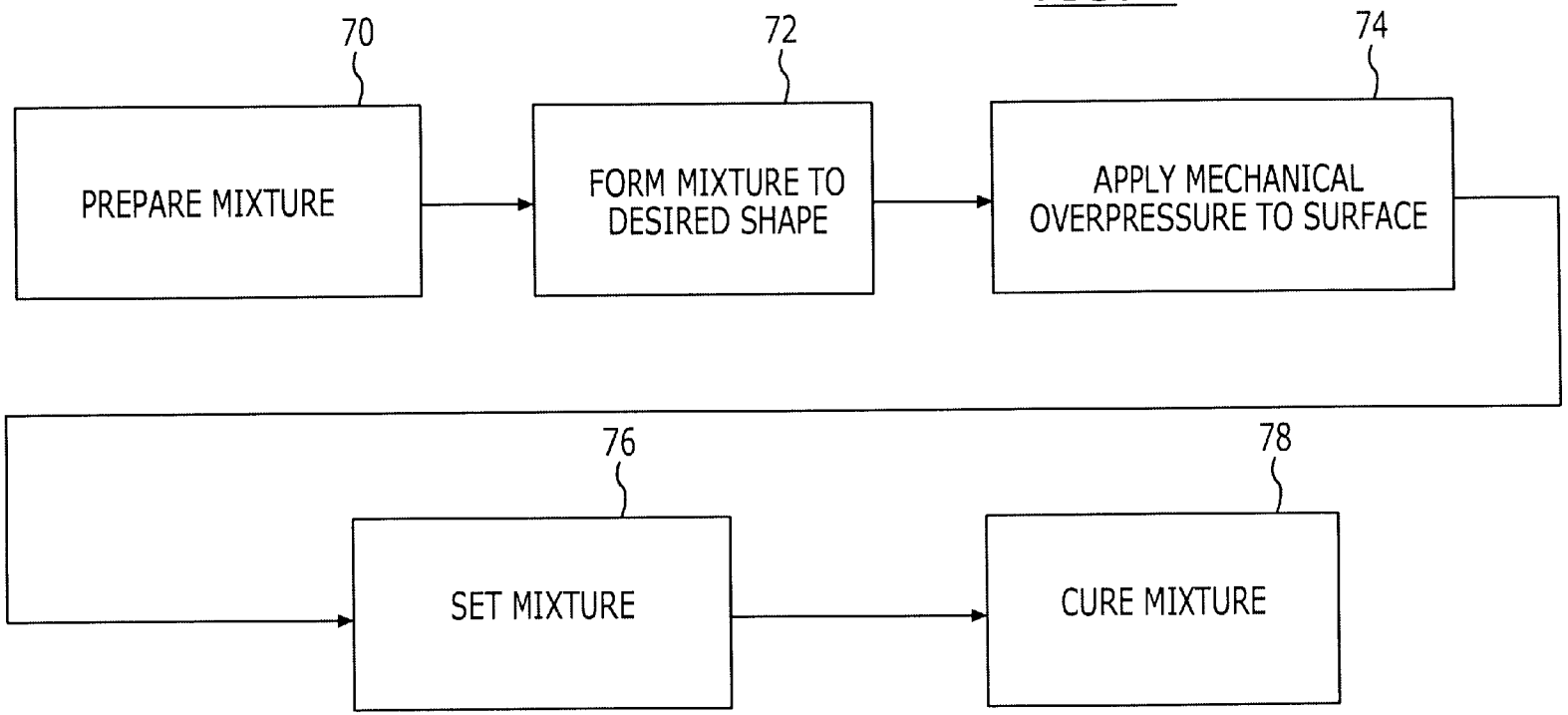
FIG. 4 is a flow chart for the preparation of the bulk ceramic article of FIG. 3.

To prepare a bulk ceramic article 60 by the process depicted in FIG. 4, a ceramic-containing mixture is prepared 70. The mixture is prepared by the same procedures as discussed in relation to the preparation step 42 of FIG. 2.

The mixture is formed to the desired bulk shape, numeral 72. Forming may be by any operable approach, such as casting, slip casting, ram pressing, rolling, doctor blade, etc.

Inasmuch as moisture is removed from the bulk shape during subsequent setting, it is desirable that the bulk shape have one dimension that is relatively thin, preferably no more than about one inch. On the other hand, thicker pieces may be made by heating the article very slowing in subsequent setting, to drive out the moisture before the ceramic mixture sets.

After the shape is formed, a mechanical overpressure is applied to the surface 62, numeral 74 of FIG. 4. The surface of the pressing tool is important in determining the texture and reflectance of the surface 62, as discussed previously. The ceramic mixture is set, numeral 76. These steps are accomplished by the same procedures described in relation to the steps 46 and 48 of FIG. 2, and in general the same considerations apply. However, for thicker ceramic pieces, it is preferred to heat to the setting temperature very slowly to permit the expelling of moisture without damage to the ceramic piece. The mechanical overpressure application 74 and setting 76 may be accomplished separately, or concurrently as described previously in relation to steps 46 and 48 of FIG. 2.

The set ceramic bulk article 60 is cured, numeral 78, using the same procedures described previously in relation to the step 50 of FIG. 2.

Substantially the same results are attained for the bulk ceramic article 60 as described previously for the coated article 20.

The present approach provides a method for preparing a ceramic surface of controllable reflectivity in the visible wavelength range. The macroscopic texture of the surface can be controlled, without losing control of the reflectivity properties. Although a particular embodiment of the invention has been described in detail for purposes of illustration, various modifications may be made without departing from the spirit and scope of the invention. Accordingly, the invention is not to be limited except as by the appended claims.

What is claimed is:

1. An article having a ceramic surface whose texture and reflectance are controllable, the article prepared by method of:

providing an article having a surface to be coated;

preparing an aqueous mixture of a source of a reactive phosphate ion and a nonmetallic ceramic form of a cation reactive with phosphate ion to form a ceramic phosphate, wherein the nonmetallic ceramic form of the cation has at least two size ranges including at least a finer size range and a courser size range;

contacting the mixture to the surface of the article;

applying a mechanical overpressure to the mixture while the mixture is in contact with the surface of the article to form a coating;

setting the coating; and curing the coating.

2. The article of claim 1, wherein the step of providing an article includes the step of:

providing the article made of a material selected from the group consisting of a metal, a metal-matrix composite, a ceramic, a ceramic-matrix composite, an organic material, and an organic-matrix composite.

3. The article of claim 1, wherein the step of preparing an aqueous mixture includes the step of providing the source of reactive phosphate ions selected from the group consisting of phosphoric acid and monoaluminum phosphate.

4. The article of claim 1, wherein the step of preparing an aqueous mixture includes the step of providing the source of the nonmetallic ceramic form of a cation reactive with phosphate ion wherein the cation is selected from the group consisting of beryllium, aluminum, iron, magnesium, calcium, thorium, barium, zirconium, zinc, silicon, and mixtures thereof.

5. The article of claim 1, herein the step of preparing an aqueous mixture includes the step of providing the source of the nonmetallic ceramic form of a cation reactive with phosphate ion wherein the source is an oxide of the cation.

6. The article of claim 1, wherein the step of contacting includes the steps of:

forming a first layer of mixture, placing a second layer of the mixture onto the surface of the article and contacting the second layer of the mixture to the first layer of the mixture.

7. The article of claim 1, wherein the step of applying a mechanical overpressure includes the step of pressing against the mixture in contact with the surface of the article with a pressing tool.

8. The article of claim 7, wherein the step of pressing includes the step of supplying a pressing tool having a surface with a pattern thereon that is visible to the naked eye.

9. The article of claim 1, wherein the step of applying a mechanical overpressure includes the step of applying a pressure of from about 50 to about 200 pounds per square inch.

10. The article of claim 1, including the additional step, after the step of preparing and before the step of contacting, of deairing the mixture.

11. The article of claim 1, wherein the step of providing an article includes the step of providing the article which is attached to a larger structure, without detaching the article from the larger structure.

12. An article having a ceramic surface whose texture and reflectance are controllable, the article prepared by a method of:

providing an article having a surface to be coated;

preparing an aqueous mixture of phosphoric acid, alumina powder, and cordierite powder;

contacting the mixture to the surface of the article;

pressing against the mixture in contact with the surface of the article with a pressing tool to form a coating;

heating the coating to a first temperature to set the coating; and heating the coating to a second temperature greater than the first temperature to cure the coating.

13. An article having a ceramic surface whose texture and reflectance are controllable, the article prepared by a method of:

preparing an aqueous mixture of a source of a reactive phosphate ion and a nonmetallic ceramic form of a cation reactive with phosphate ion to form a ceramic phosphate;

placing the mixture at the surface of an article;

applying a mechanical overpressure to the mixture at the surface of the article using a pressing tool having a surface with a pattern thereon that is visible to the naked eye;

setting the mixture; and curing the mixture.

14. The article of claim 13, wherein the step of placing the mixture includes the step of preparing the entire article from the mixture.

* * * * *